US010670236B1

(12) United States Patent
Xu

(10) Patent No.: US 10,670,236 B1
(45) Date of Patent: Jun. 2, 2020

(54) PLUG-IN LED LAMP HOLDER

(71) Applicant: Xiaojun Xu, Jiangmen (CN)

(72) Inventor: Xiaojun Xu, Jiangmen (CN)

( * ) Notice: Subject to any disclaimer, the term of this patent is extended or adjusted under 35 U.S.C. 154(b) by 0 days.

(21) Appl. No.: 16/532,447

(22) Filed: Aug. 5, 2019

(30) Foreign Application Priority Data

Jul. 9, 2019 (CN) ..... 2019 2 1070905 U

(51) Int. Cl.

| | |
|---|---|
| ***F21V 15/01*** | (2006.01) |
| ***F21V 31/00*** | (2006.01) |
| ***F21V 23/00*** | (2015.01) |
| *F21Y 115/10* | (2016.01) |

(52) U.S. Cl.
CPC ..... *F21V 15/01* (2013.01); *F21V 23/001* (2013.01); *F21V 31/005* (2013.01); *F21Y 2115/10* (2016.08)

(58) Field of Classification Search
CPC ..... F21V 15/01; F21V 31/005; F21V 23/001
See application file for complete search history.

(56) References Cited

U.S. PATENT DOCUMENTS

2015/0345765 A1* 12/2015 Horst ..... F21S 2/005 362/362
2019/0319470 A1* 10/2019 Chien ..... F21S 8/035

* cited by examiner

*Primary Examiner* — Thomas M Sember

(57) ABSTRACT

A plug-in LED lamp holder is provided, including a first housing, a second housing and a core shaft, wherein each of the first housing and the second housing has a semicircular tubular structure and is provided at a top portion thereof with a connecting block, the connecting block has a triangular plate shape and is provided with a connecting hole formed thereon, each of the first housing and the second housing is provided with a semicircular side tube communicating with an inner side thereof, a plurality of semi-annular inner ribs are provided on an inner wall of the side tube, the first housing and the second housing are assembled to define a cylindrical cavity on a bottom thereof, the first housing and the second housing are respectively provided on the cylindrical cavity with a first thread and a second thread which together form a complete thread.

10 Claims, 7 Drawing Sheets

PLUG-IN LED LAMP HOLDER

CROSS-REFERENCE TO RELATED APPLICATIONS

This application claims priority to Chinese Patent Application No. 201921070905.0, filed Jul. 9, 2019, which is hereby incorporated by reference herein as if set forth in its entirety.

TECHNICAL FIELD

The present discloser relates to a technical field of a lamp appliance, more particularly to a ground-inserted LED lamp holder.

BACKGROUND

A lamp appliance is an appliance that transmits and distributes light, and changes the light distribution of the light source, including, except light source, all parts and components required to secure and protect the light source, and wiring accessories necessary to connect with the power source. The lamp appliance, as a kind of luminaire, enables a light source to reliably emit light in order to meet demands for light of people engaged in various activities. An electrical lamp appliance includes an optical component, an electrical component and a mechanical component in addition to an electric light source. Most of lamp holders have no drainage function and need to be fixed by mechanical structures such as screws.

SUMMARY

An object of the present disclosure is to provide a plug-in LED lamp holder for solving the aforementioned technical problems.

The following technical schemes are used for achieving the aforementioned object. A plug-in LED lamp holder is provided, including a first housing, a second housing and a core shaft, wherein the first housing and the second housing are similar in structure, each of the first housing and the second housing has a semicircular tubular structure and is provided at a top portion thereof with a connecting block, the connecting block has a triangular plate shape and is provided with a connecting hole formed thereon, each of the first housing and the second housing is provided with a semicircular side tube symmetrically arranged on a shoulder thereof and communicating with an inner side thereof, a plurality of semi-annular inner ribs are provided on an inner wall of the side tube, the first housing and the second housing are assembled to define a cylindrical cavity on a bottom thereof, the first housing and the second housing are respectively provided on the cylindrical cavity with a first thread and a second thread which together form a complete thread when the first housing and the second housing are assembled, each of the first housing and the second housing has a semicircular bottom opening at a bottom thereof, a protruding rib having a triangular shape in cross-section is provided on a contact surface of the first housing, a sealing slot is provided on the second housing and matches with the protruding rib. The first housing and the second housing are fixedly connected and are sealed by ultrasonic.

In some embodiments, the first housing defines an inner cavity that is provided with a first partition plate and an upper retaining plate, each of which is provided with a semicircular first recess, and two connecting posts are located between the upper retaining plate and the first partition plate.

In some embodiments, the second housing is provided inside with a first partition plate which has a second recess located thereon, and the second housing is further provided inside with two mounting tubes each of which has a tube hole located therein.

In some embodiments, the core shaft has a cylindrical shape as a whole, two semicircular grooves are horizontally positioned at an upper side of the core shaft, two square holes are vertically positioned below the semicircular grooves, two shaft-main grooves are located on an upper end surface of the core shaft, each of the shaft-main grooves is provided with a bottom hole located at a bottom thereof and extended through a bottom of the core shaft, each of the shaft-main grooves is further provided with a side opening located at a side thereof, and the square holes communicate with the shaft-main grooves in such a way that each of the shaft-main grooves communicates only with a respective one of the square holes and does not simultaneously communicate with both square holes.

In some embodiments, each of the side tubes on the first housing and the second housing is provided with a plurality of outer grooves which is approximately semicircular in shape, and between each two adjacent outer grooves define an outer rib.

In some embodiments, the first housing defines an inner cavity that is provided with a first partition plate which has a semicircular first recess, and two connecting posts are located above the first partition plate.

In some embodiments, the first partition plate is provided with a positioning slot communicating with the first recess.

In some embodiments, a semicircular groove are horizontally positioned at an upper side of the core shaft, two square holes are vertically positioned below the semicircular groove, two shaft-main grooves are located on an upper end surface of the core shaft, each of the shaft-main grooves is provided with a bottom hole located at a bottom thereof and extended through a bottom of the core shaft, each of the shaft-main grooves is further provided with a side opening located at a side thereof, the square holes communicate with the shaft-main grooves in such a way that each of the shaft-main grooves communicates only with a respective one of the square holes and does not simultaneously communicate with both square holes.

In some embodiments, the semicircular groove is provided with a positioning post perpendicularly protruding therefrom.

In some embodiments, a wiring post is further provided in the inner cavity of the first housing.

The plug-in LED lamp holder according to the present disclosure has the following technical effects and advantages: the first housing and the second housing are similar in shape, which provides convenience for mold designing and manufacturing; the ultrasonic sealing has a better fixing effect when compared with a traditional screw fixing, the cooperation of the protruding rib and the sealing slot provides a waterproof function; the inner rib facilitates to prevent liquid from flowing into the gap between the side tube and an external electrical wire, and meanwhile further facilitates to secure the external electrical wire.

Figure 1:
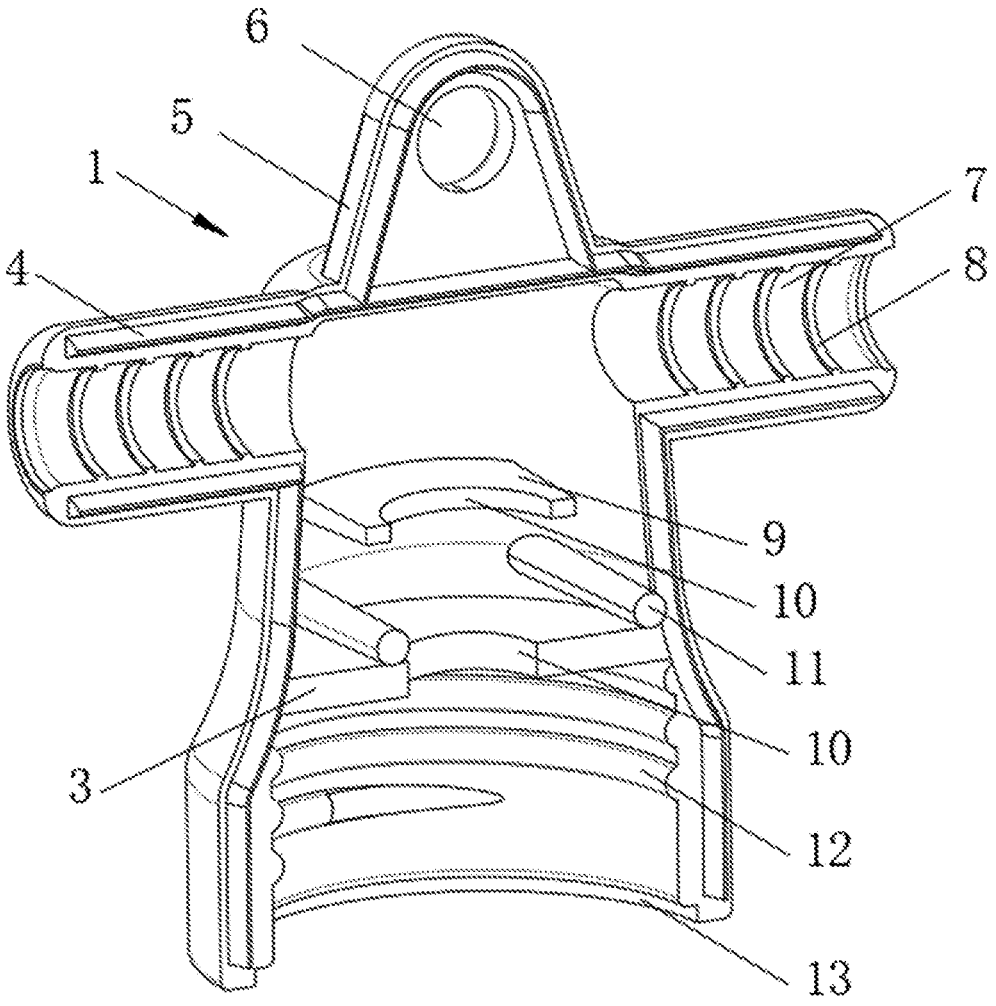
FIG. 1 schematically shows a structural view of a first housing according to the present disclosure.

In the drawings, the reference numbers are referred to: 1, first housing; 2, second housing; 3, first partition plate; 4, protruding rib; 5, connecting block; 6, connecting hole; 7, side tube; 8, inner rib; 9, upper retaining plate; 10 first recess; 11, connecting post; 12, first thread; 13, bottom opening; 14, sealing slot; 15, mounting tube; 16, end opening; 17, second recess; 18, second thread; 19, square hole; 20, semicircular groove; 21, shaft-main groove; 22, bottom hole; 23, side opening; 24, core shaft; 25, outer groove; 26, outer rib; 27, positioning slot; 28, positioning post; 29, wiring post.

DETAILED DESCRIPTION

Embodiments according to the present disclosure will be further described below with reference to the accompanying drawings for more clearly and fully discussing the technical solutions of the present disclosure. Apparently, the described embodiments are only a part of the embodiments of the present disclosure, and not all of them. Modifications and variations made by those skilled in the art based on the embodiments according to the present disclosure without any creative work fall within the protection scope of the present disclosure.

Embodiment 1

Figure 2:
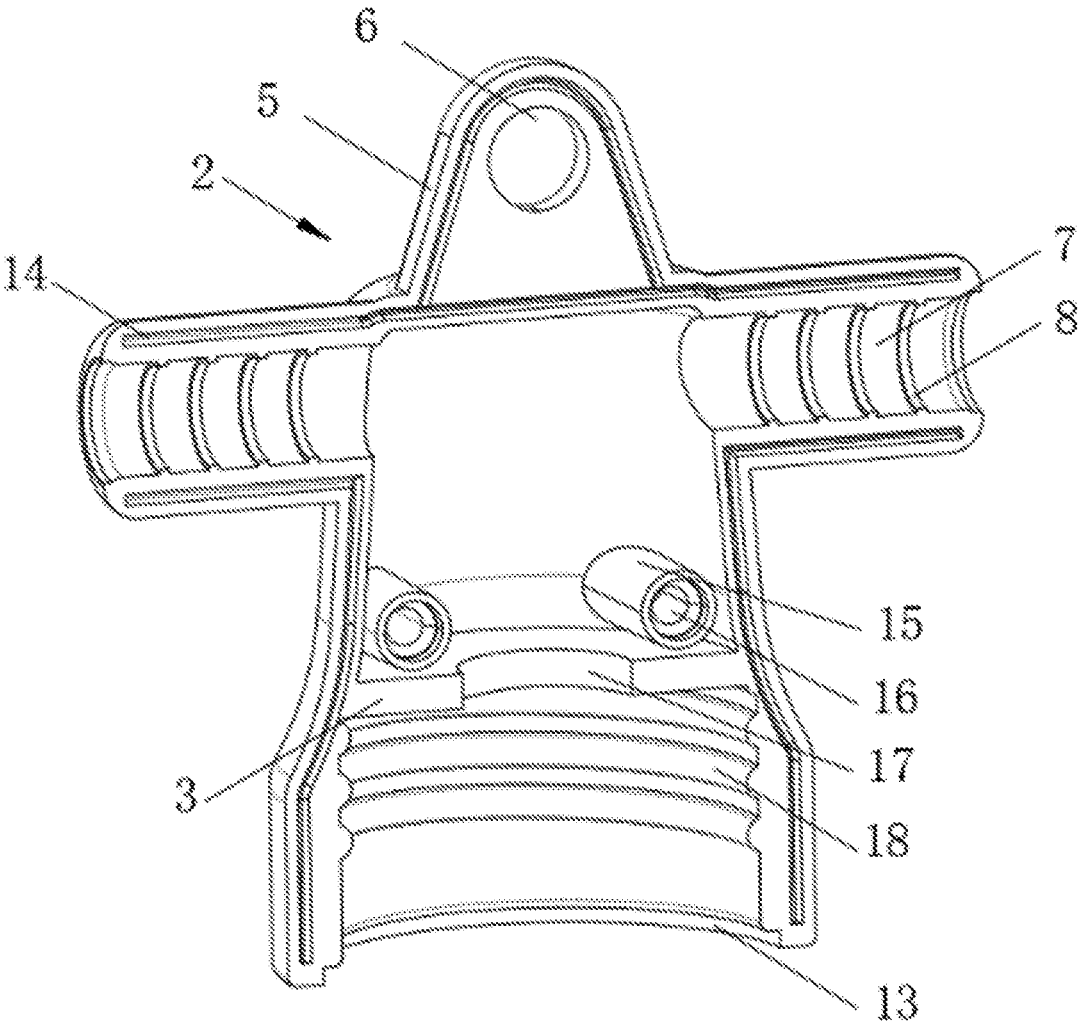
FIG. 2 schematically shows a structural view of a second housing according to the present disclosure.
Figure 3:
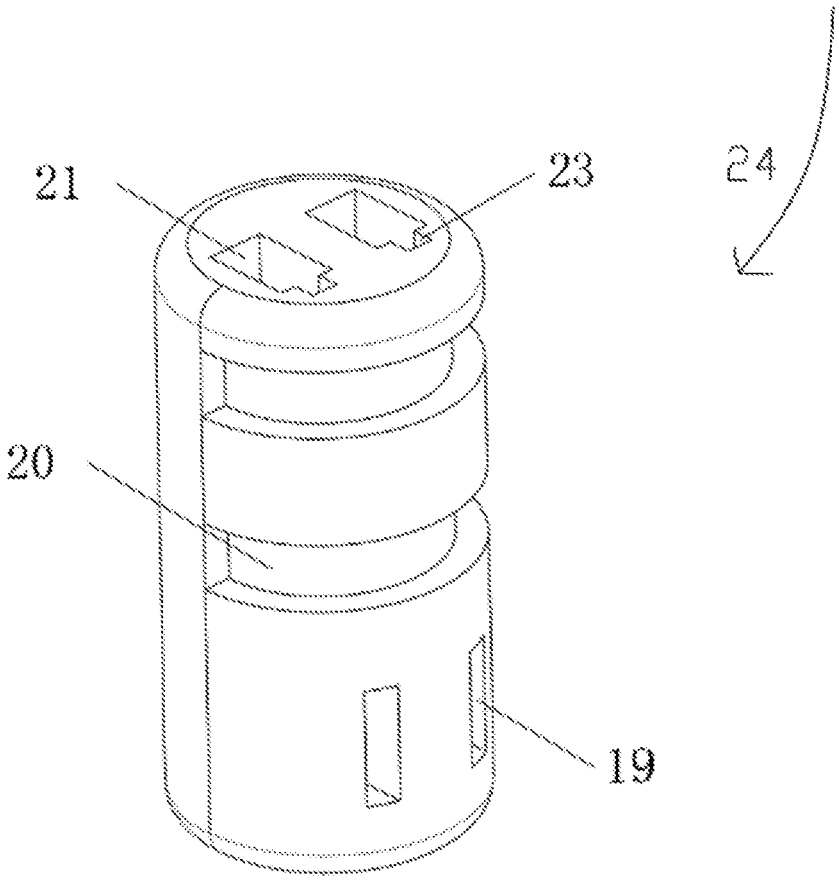
FIG. 3 schematically shows a structural view of a core shaft according to the present disclosure.
Figure 4:
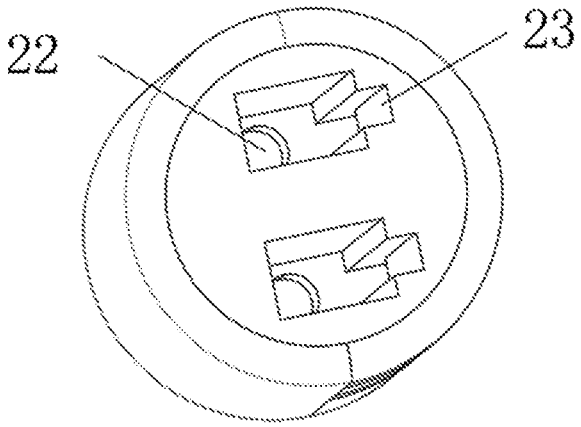
FIG. 4 schematically shows a structural view of a bottom hole according to the present disclosure.
Figure 5:
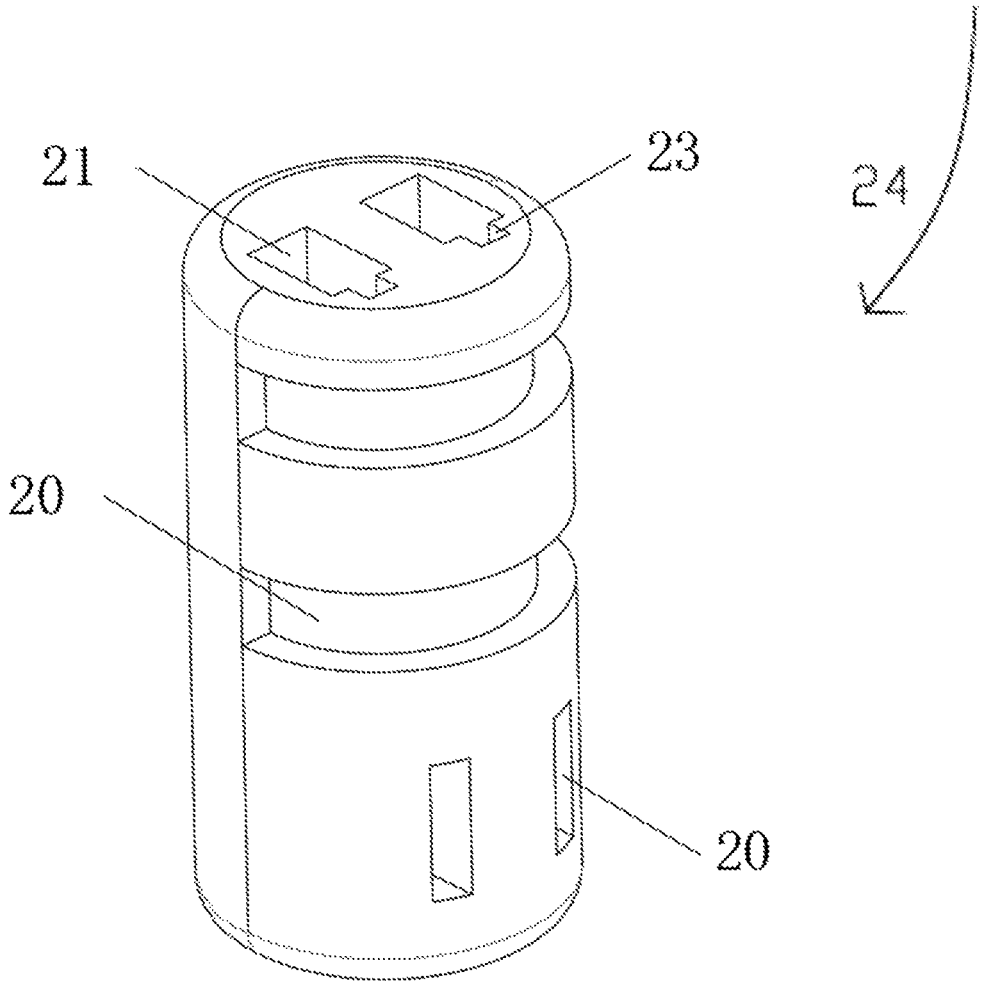
FIG. 5 schematically shows a structural view of a side face of the core shaft according to the present disclosure.
Figure 6:
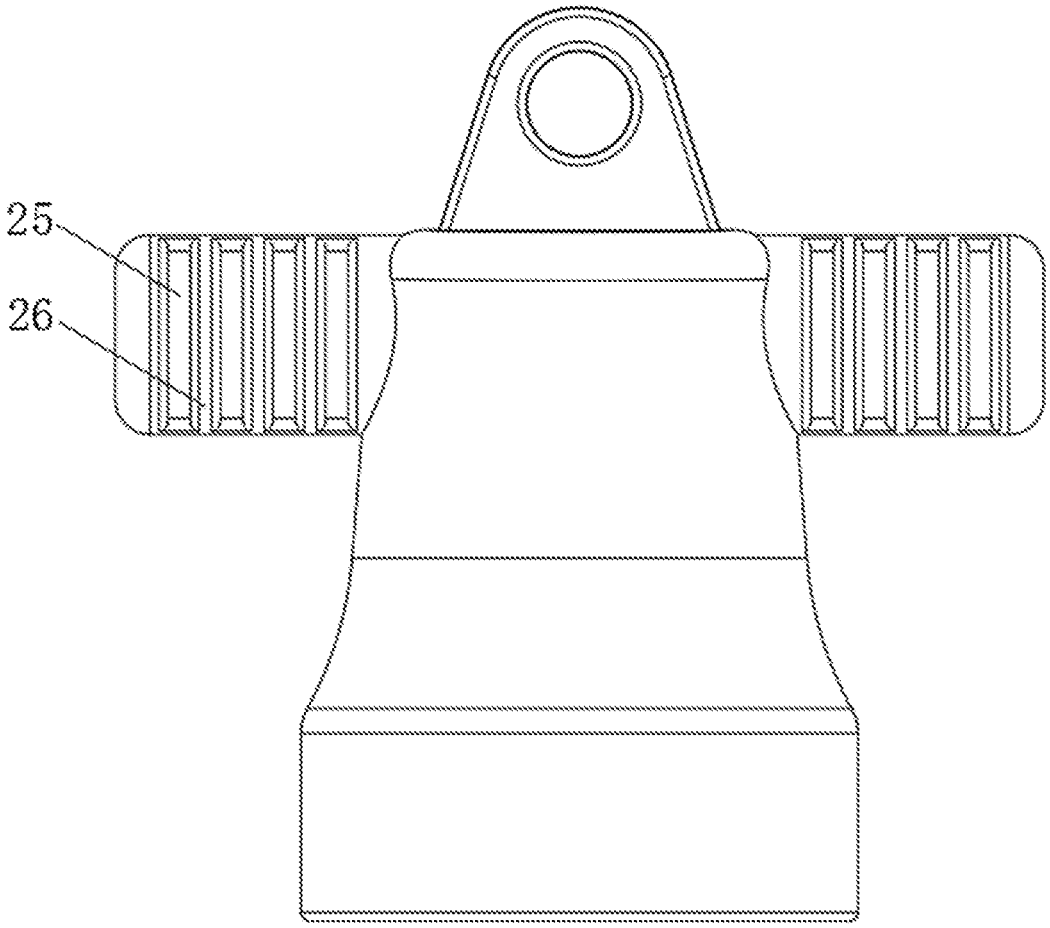
FIG. 6 schematically shows an external view of a side tube according to the present disclosure.

As shown in FIGS. 1-6, a plug-in LED lamp holder is provided according to the present disclosure, including a first housing 1, a second housing 2 and a core shaft 24. The first housing 1 and the second housing 2 are similar in structure, each having a semicircular tubular structure. Each of the first housing 1 and the second housing 2 is provided at a top portion thereof with a connecting block 5 having a triangular plate shape. A connecting hole 6 is provided on the connection block 5. Each of the first housing 1 and the second housing 2 is provided with a semicircular side tube 7 symmetrically arranged on a shoulder thereof and communicating with an inner side thereof. A plurality of semi-annular inner ribs 8 are provided on an inner wall of the side tube 7, which are configured to allow the side tube 7 to firmly secure an external electrical wire, and prevent liquid from flowing into a gap between the external electrical wire and the side tube 7. The first housing 1 and the second housing 2 are assembled to define a cylindrical cavity on a bottom thereof. The first housing 1 and the second housing 2 are respectively provided on the cylindrical cavity with a first thread 12 and a second thread 18. When the first housing 1 and the second housing 2 are assembled, the first thread 12 and the second thread 18 form a complete thread. Each of the first housing 1 and the second housing 2 has a semicircular bottom opening 13 at a bottom thereof. The bottom opening 13 is configured to place components such as a sealing ring and a vibration absorbing ring. A protruding rib 4 having a triangular shape in cross-section is provided on a contact surface of the first housing 1. A sealing slot 14 is provided on the second housing 2 and matches with the protruding rib 4. The design of the sealing slot 14 and the protruding rib 4 prevents liquid from flowing into the first housing 1 and the second housing 2. The first housing 1 and the second housing 2 are fixedly connected and are scaled by ultrasonic.

Specifically, the first housing 1 defines an inner cavity that is provided with a first partition plate 3 and an upper retaining plate 9, each of which is provided with a semicircular first recess 10. Two connecting posts 11 are located between the upper retaining plate 9 and the first partition plate 3. Each of the connecting posts 11 is of conical shape. The first recess 10 has a profile matching that of a semicircular groove 20 on the core shaft 24.

Specifically, the second housing 2 is provided inside with a first partition plate 3 which has a second recess 17 located thereon. The second housing 2 is further provided inside with two mounting tubes 15 each of which has a tube hole 16 located therein. The second recess 17 has a profile matching that of the core shaft 24.

Specifically, the core shaft 24 has a cylindrical shape as a whole. Two semicircular grooves 20 are horizontally positioned at an upper side of the core shaft 24. Two square holes 19 are vertically positioned below the semicircular grooves 20. Two shaft-main grooves 21 are located on an upper end surface of the core shaft 24. Each of the shaft-main grooves 21 is provided with a bottom hole 22 located at a bottom thereof and extended through a bottom of the core shaft 24. Each of the shaft-main grooves 21 is further provided with a side opening 23 located at a side thereof. The square holes 19 communicate with the shaft-main grooves 21. Each of the shaft-main grooves 21 communicates only with a respective one of the square holes 19 and does not simultaneously communicate with both square holes 19, so that the shaft-main groove 21 and the respective square hole 19 communicating therewith form a separate space.

Specifically, each of the side tubes 7 on the first housing 1 and the second housing 2 is provided with a plurality of outer grooves 25 which is approximately semicircular in shape. Between each two adjacent outer grooves 25 define an outer rib 26.

Specifically, in the plug-in LED lamp holder according to the present disclosure, the first housing 1 and the second housing 2 are sealed together, the side tubes 7 are configured to secure the external electrical wire, and the inner ribs 8 inside the side tubes 7 are configured to prevent the liquid from flowing into the gap between the external electrical wire and the side tubes 7. The semicircular grooves 20 of the core shaft 24 are locked by the first recesses 10 on the upper retaining plate 9 and the first partition plate 3, respectively. A surface of the core shaft 24 facing away from the semicircular grooves 20 is abutted against the second recess 17 on the first partition plate 3 of the second housing 2. The connecting posts 11 are inserted into the end openings 16 of the mounting tubes 15, so as to fix the first housing 1 to the second housing 2. The protruding rib 4 of the first housing 1 is inserted into the sealing groove 14 of the second housing 2 to seal the inner space defined by the first housing 1 and the second housing 2.

Embodiment 2

Figure 7:
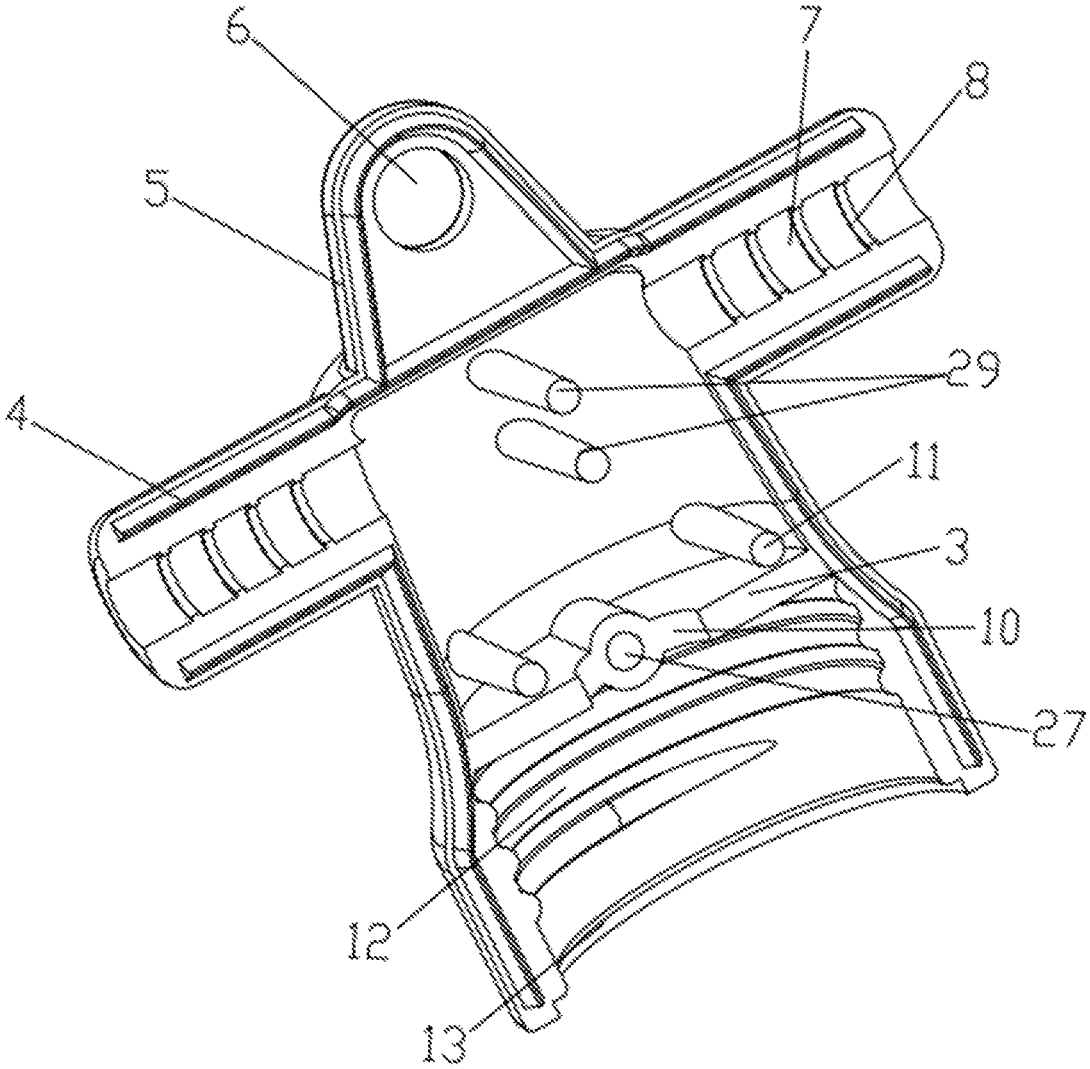
FIG. 7 schematically shows a structural view of a first housing according to another embodiment of the present disclosure.
Figure 8:
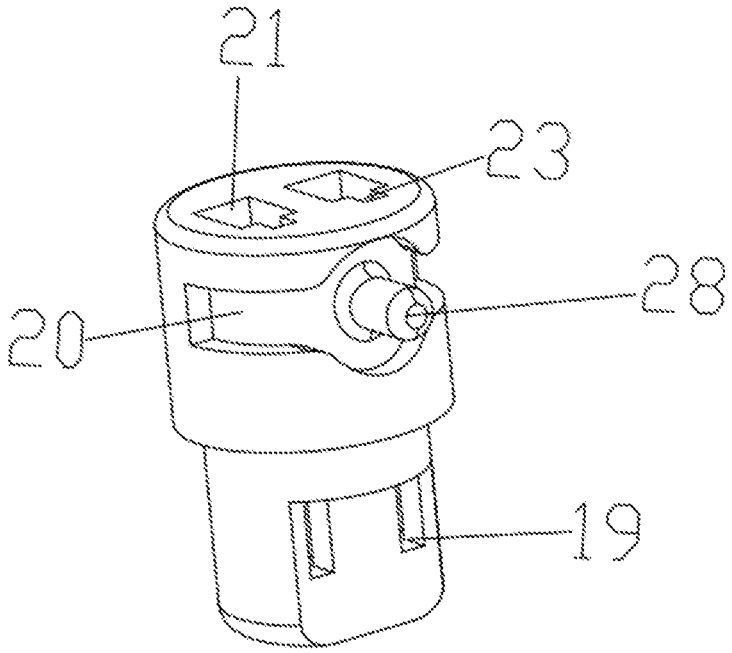
FIG. 8 schematically shows a structural view of a core shaft according to another embodiment of the present disclosure.
Figure 9:
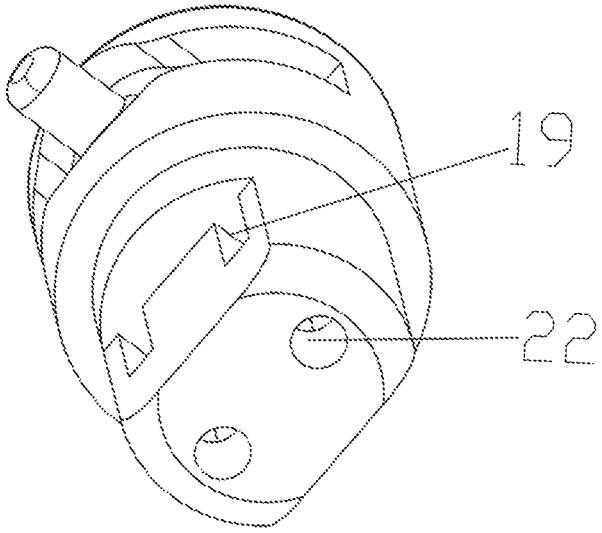
FIG. 9 schematically shows a structural view of the core shaft of FIG. 8 from another viewpoint.

As shown in FIGS. 2 and 6-9, a plug-in LED lamp holder is provided according to the present disclosure, including a first housing 1, a second housing 2 and a core shaft 24. The first housing 1 and the second housing 2 are similar in structure, each having a semicircular tubular structure. Each of the first housing 1 and the second housing 2 is provided at a top portion thereof with a connecting block 5 having a triangular plate shape. A connecting hole 6 is provided on the connection block 5. Each of the first housing 1 and the second housing 2 is provided with a semicircular side tube 7 symmetrically arranged on a shoulder thereof and communicating with an inner side thereof. A plurality of semi-annular inner ribs 8 are provided on an inner wall of the side tube 7, which are configured to allow the side tube 7 to firmly secure an external electrical wire, and prevent liquid from flowing into a gap between the external electrical wire and the side tube 7. The first housing 1 and the second housing 2 are assembled to define a cylindrical cavity on a bottom thereof. The first housing 1 and the second housing 2 are respectively provided on the cylindrical cavity with a first thread 12 and a second thread 18. When the first housing 1 and the second housing 2 are assembled, the first thread 12 and the second thread 18 form a complete thread. Each of the first housing 1 and the second housing 2 has a semicircular bottom opening 13 at a bottom thereof. The bottom opening 13 is configured to place components such as a sealing ring and a vibration absorbing ring. A protruding rib 4 having a triangular shape in cross-section is provided on a contact surface of the first housing 1. A sealing slot 14 is provided on the second housing 2 and matches with the protruding rib 4. The design of the sealing slot 14 and the protruding rib 4 prevents the liquid from flowing into the first housing 1 and the second housing 2. The first housing 1 and the second housing 2 are fixedly connected and are sealed by ultrasonic.

Specifically, the first housing 1 defines an inner cavity that is provided with a first partition plate 3 has a semicircular first recess 10 located thereon. Two connecting posts 11 are located above the first partition plate 3. Each of the connecting posts 11 is of conical shape. The first recess 10 has a profile matching that of a semicircular groove 20 on the core shaft 24.

Specifically, the second housing 2 is provided inside with a first partition plate 3 which has a second recess 17 located thereon. The second housing 2 is further provided inside with two mounting tubes 15 each of which has a tube hole 16 located therein. The second recess 17 has a profile matching that of the core shaft 24.

Specifically, the core shaft 24 has a cylindrical portion and a cuboid portion. Two edges of the cuboid portion located opposite to the cylindrical portion are arc-shaped. A semicircular groove 20 is horizontally positioned at an upper side of the core shaft 24. Two square holes 19 are vertically positioned below the semicircular groove 20. Two shaft-main grooves 21 are located on an upper end surface of the core shaft 24. Each of the shaft-main grooves 21 is provided with a bottom hole 22 located at a bottom thereof and extended through a bottom of the core shaft 24. Each of the shaft-main grooves 21 is further provided with a side opening 23 located at a side thereof. The square holes 19 communicate with the shaft-main grooves 21. Each of the shaft-main grooves 21 communicates only with a respective one of the square holes 19 and does not simultaneously communicate with both square holes 19, so that the shaft-main groove 21 and the respective square hole 19 communicating therewith form a separate space.

Specifically, the first partition plate 3 is provided with a positioning slot 27 communicating with the first recess 10. The semicircular groove 20 is provided with a positioning post 28 perpendicularly protruding therefrom. When the core shaft 24 is snapped into the first recess 10 and the second recess 17, the positioning post 28 is inserted into the positioning slot 27, such that the core shaft 24 is further positioned and fixing force between the core shaft 24 and the first recess 10 and the second recess 17 is enhanced, which facilitates quick assembly and mounting.

Specifically, each of the side tubes 7 on the first housing 1 and the second housing 2 is provided with a plurality of outer grooves 25 which is approximately semicircular in shape. Between each two adjacent outer grooves 25 define an outer rib 26.

Specifically, a wiring post 29 is further provided in the inner cavity of the first housing 1. The wiring post 29 is configured to facilitate the external electrical wire running inside the lamp holder and avoid jumbling of the external electrical wire.

Specifically, in the plug-in LED lamp holder according to the present disclosure, the first housing 1 and the second housing 2 are sealed together, the side tubes 7 are configured to secure the external electrical wire, and the inner ribs 8 inside the side tubes 7 are configured to prevent the liquid from flowing into the gap between the external electrical wire and the side tubes 7. The semicircular groove 20 of the core shaft 24 is locked by the first recess 10 on the first partition plate 3. A surface of the core shaft 24 facing away from the semicircular groove 20 is abutted against the second recess 17 on the first partition plate 3 of the second housing 2. The connecting posts 11 are inserted into the end openings 16 of the mounting tubes 15, so as to fix the first housing 1 to the second housing 2. The protruding rib 4 of the first housing 1 is inserted into the sealing groove 14 of the second housing 2 to seal the inner space defined by the first housing 1 and the second housing 2.

It should be noted that described above are only preferred embodiments of the present disclosure and are not intended to limit the present disclosure. Although the present disclosure is described in detail with reference to the foregoing embodiments, it is still possible for a person skilled in the art to modify the technical solutions described in the foregoing embodiments, or to equally replace some of the technical features therein. Any equivalent changes and modification made within the scope of the claims of the present disclosure shall be covered by the scope of the claims of the present disclosure.

What is claimed is:

1. A plug-in LED lamp holder, comprising a first housing, a second housing and a core shaft, wherein the first housing and the second housing are similar in structure, each of the first housing and the second housing has a semicircular tubular structure and is provided at a top portion thereof with a connecting block, the connecting block has a triangular plate shape and is provided with a connecting hole formed thereon, each of the first housing and the second housing is provided with a semicircular side tube symmetrically arranged on a shoulder thereof and communicating with an inner side thereof, a plurality of semi-annular inner ribs are provided on an inner wall of the side tube, the first housing and the second housing are assembled to define a cylindrical cavity on a bottom thereof, the first housing and the second housing are respectively provided on the cylindrical cavity with a first thread and a second thread which together form a complete thread when the first housing and the second housing are assembled, each of the first housing and the second housing has a semicircular bottom opening at a bottom thereof, a protruding rib having a triangular shape in cross-section is provided on a contact surface of the first housing, a sealing slot is provided on the second housing and matches with the protruding rib, and the first housing and the second housing are fixedly connected.

2. The plug-in LED lamp holder according to claim 1, wherein the first housing defines an inner cavity that is provided with a first partition plate and an upper retaining plate, each of which is provided with a semicircular first recess, and two connecting post are located between the upper retaining plate and the first partition plate.

3. The plug-in LED lamp holder according to claim 1, wherein the second housing is provided inside with a first partition plate which has a second recess located thereon, and the second housing is further provided inside with two mounting tubes each of which has a tube hole located therein.

4. The plug-in LED lamp holder according to claim 1, wherein the core shaft has a cylindrical shape as a whole, two semicircular grooves are horizontally positioned at an upper side of the core shaft, two square holes are vertically positioned below the semicircular grooves, two shaft-main grooves are located on an upper end surface of the core shaft, each of the shaft-main grooves is provided with a bottom hole located at a bottom thereof and extended through a bottom of the core shaft, each of the shaft-main grooves is further provided with a side opening located at a side thereof, and the square holes communicate with the shaft-main grooves in such a way that each of the shaft-main grooves communicates only with a respective one of the square holes and does not simultaneously communicate with both square holes.

5. The plug-in LED lamp holder according to claim 1, wherein each of the side tubes on the first housing and the second housing is provided with a plurality of outer grooves which is approximately semicircular in shape, and between each two adjacent outer grooves define an outer rib.

6. The plug-in LED lamp holder according to claim 1, wherein the first housing defines an inner cavity that is provided with a first partition plate which has a semicircular first recess, and two connecting posts are located above the first partition plate.

7. The plug-in LED lamp holder according to claim 6, wherein the first partition plate is provided with a positioning slot communicating with the first recess.

8. The plug-in LED lamp holder according to claim 1, wherein a semicircular groove is horizontally positioned at an upper side of the core shaft, two square holes are vertically positioned below the semicircular groove, two shaft-main grooves are located on an upper end surface of the core shaft, each of the shaft-main grooves is provided with a bottom hole located at a bottom thereof and extended through a bottom of the core shaft, each of the shaft-main grooves is further provided with a side opening located at a side thereof, the square holes communicate with the shaft-main grooves in such a way that each of the shaft-main grooves communicates only with a respective one of the square holes and does not simultaneously communicate with both square holes.

9. The plug-in LED lamp holder according to claim 8, wherein the semicircular groove is provided with a positioning post perpendicularly protruding therefrom.

10. The plug-in LED lamp holder according to claim 1, wherein a wiring post is further provided in the inner cavity of the first housing.

* * * * *